US005383268A

United States Patent [19]

Clark

[11] Patent Number: 5,383,268

[45] Date of Patent: Jan. 24, 1995

[54] LOCATING TOOL FOR POWER PINS AND RECEPTACLES

[75] Inventor: Stephen L. Clark, Dillsburg, Pa.

[73] Assignee: E. I. Du Pont de Nemours and Company, Wilmington, Del.

[21] Appl. No.: 34,829

[22] Filed: Mar. 12, 1993

Related U.S. Application Data

[62] Division of Ser. No. 891,380, May 29, 1992, Pat. No. 5,237,739.

[51] Int. Cl.[6] ..... H01R 43/00

[52] U.S. Cl. ..... 29/747; 29/271; 29/281.5; 29/281.6; 29/759

[58] Field of Search ..... 29/747, 759, 271, 281.5, 29/281.6, 739

[56] References Cited

U.S. PATENT DOCUMENTS 3,601,770 8/1971 Bowley .

4,887,981 11/1987 Damon et al. ..... 439/885

*Primary Examiner*—Carl E. Hall

*Attorney, Agent, or Firm*—Woodcock Washburn Kurtz Mackiewicz & Norris

[57] ABSTRACT

Disposable tools for locating a power receptacle or a power pin within the corresponding port therefor in a header housing are disclosed. The tool for positioning a receptacle within a port includes a base having a positioning contour and a plug having an axis therethrough extending from the base. The plug is sized such that when the positioning contour on the base is engaged against at least two opposed lead-in surfaces about the port the plug extends into the barrel of the first receptacle to align the axis of the same with the axis of the port.

The tool for positioning a pin within a port includes a sleeve having a central bore extending therethrough and an outer positioning surface thereon. The power pin is receivable in and retainable by the sleeve. The sleeve is sized such that when the positioning surface thereon engages against at least two opposed surfaces of the port the axis of the pin is retained in a predetermined relationship with the housing.

4 Claims, 10 Drawing Sheets

LOCATING TOOL FOR POWER PINS AND RECEPTACLES

This is a division of application Ser. No. 07/891,380, filed May 29, 1992 now U.S. Pat. No. 5,237,739.

BACKGROUND OF THE INVENTION

1. Field of the Invention

The present invention relates to disposable tool useful for maintaining one or more receptacles or one or more power pins within a header therefor during transport of the same.

2. Description of the Prior Art

In usual practice a power header having one or more receptacles or one or more power pins therein is transported from manufacturer to customer with the receptacles or pins, as the case may be, loosely received within the header. As a consequence the customer is left with the labor intensive task of properly locating the receptacles or the pins prior to attachment of the same on the substrate which the header is to populate.

U.S. Pat. No. 4,887,981 (Damon et al.) discloses a carrier system for receptacles. U.S. Pat. No. 3,601,770 (Bowley) discloses a detachable endpiece for an edge connector that overhangs the connector housing. U.S. Pat. No. 4,693,528 (Asick et al.) discloses a connector with anchor clips.

In view of the foregoing it is believed advantageous to provide a disposable tool for locating the receptacle(s) or the pin(s) in a precise relationship with respect to the header while the header is transported. As a result misalignments of the receptacle(s) or pin(s) with respect to the header that impede the attachment thereof to the substrate are avoided.

SUMMARY OF THE INVENTION

In one aspect the present invention relates to a disposable locating tool for use with a receptacle header housing having at least one power receptacle-receiving port formed therein. The port may be typically either square or rectangular in shape. At least four lead-in surfaces leading into the first port are provided on the housing. The power receptacle-receiving port has a power pin-receiving receptacle disposed therein. The receptacle has a barrel with an axis therethrough. The axis of the barrel of the receptacle is prone to misalignment with respect to the axis of the first port.

The disposable locating tool in accordance with the invention comprises a base having a positioning contour thereon and a plug having an axis therethrough. The plug is preferably formed integrally with and extends from the base. The plug is sized such that when the positioning contour on the base is engaged against a portion of the header housing adjacent to the port, such as at least two opposed lead-in surfaces (in the event the port is rectangular) or all four lead-in surface (in the event the port is square) the plug extends into the barrel of the receptacle to bring the axis of the same into alignment with the axis of the port.

In the event the header includes additional power ports each having additional receptacle(s) therein the disposable tool may include an additional base for each additional port. The base of each additional tool has a positioning contour and an extending plug integral therewith. Each additional tool is sized such that when the positioning contour on the base with which it is associated is engaged against a portion of the header housing adjacent to the port, such as at least two opposed lead-in surfaces arranged about each additional port in the header the plug extends into the barrel of the receptacle in that port thereby to bring the axis of that barrel into alignment with the axis of the port in which it is located. Moreover, the extension of a plug into a receptacle in an adjacent port serves to space accurately the receptacles from each other. When plural tools are required the bases are linked to each other in chain-fashion by an integrally formed web.

In another aspect the present invention relates to a disposable pin locating tool for use with a pin header having a housing with one or more power pin-receiving port(s) formed therein. Each port is defined by at least four lateral surfaces. The port may be either square or rectangular in shape. Each port has a power pin with an axis therethrough disposed therewithin. When received in the power port the axis of the pin may be misaligned with respect to the header housing.

The disposable pin locating tool comprises a sleeve with a central bore and an outer positioning surface thereon. The power pin is receivable in and retainable by the sleeve. The sleeve is sized such that when the positioning surface thereon engages against at least two opposed surfaces of the port (if the port is rectangular) or engages against all four surfaces of the port (if the port is square) the axis of the pin is retained within the port in a predetermined aligned relationship with the housing. A clip integrally formed with each sleeve is attachable to the housing thereby to hold the sleeve having the power pin therein within the first port. If plural tools are required the sleeves may be connected in chain fashion by a web integrally formed between adjacent sleeves.

BRIEF DESCRIPTION OF THE DRAWINGS

The invention will be more fully understood from the following detailed description, taken in accordance with the accompanying drawings, which form a part of this application and in which:

FIG. 5A is a perspective view of the locating tool for power receptacles shown in FIGS. 4A through 4C, while

FIGS. 7A and 7B are front and rear isometric views of the locating tool for power pins shown in FIGS. 6A and 6B, while

DETAILED DESCRIPTION OF THE INVENTION

Figure 1A:
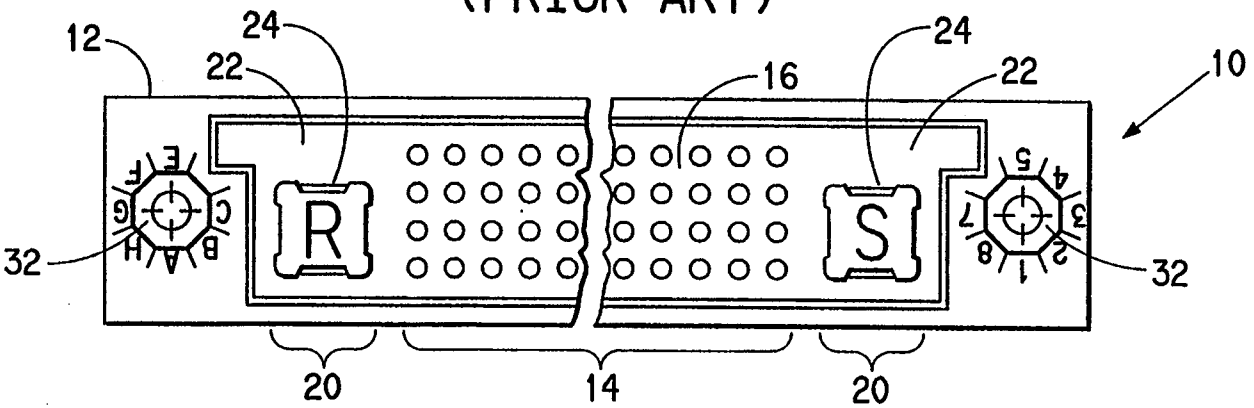
FIG. 1A (PRIOR ART)
FIGS. 1A through 1D are plan views of prior art headers having a generalized representation of a signal field and a generalized generalized representation of a power field having one or more power port(s)

Throughout the following detailed description similar reference numerals refer to similar elements in all Figures of the drawings.

FIGS. 1A through 1D are meant to convey an illustration of generic prior art headers, each header being indicated by the reference character 10. Each header 10 is a generally elongated body member 12 fabricated of a plastic or other dielectric material, as by molding. The central region 14 of the header 10 accommodates a generic field 16 of signal contacts. Depending upon the application the signal contacts may take the form of either male pin contacts or female receptacle contacts. The illustrations in FIGS. 1A through 1D are intended to be generic representations of both the pin and the receptacle form of contact. Any convenient number of horizontally disposed rows of such signal contacts may be used.

Figure 1B:
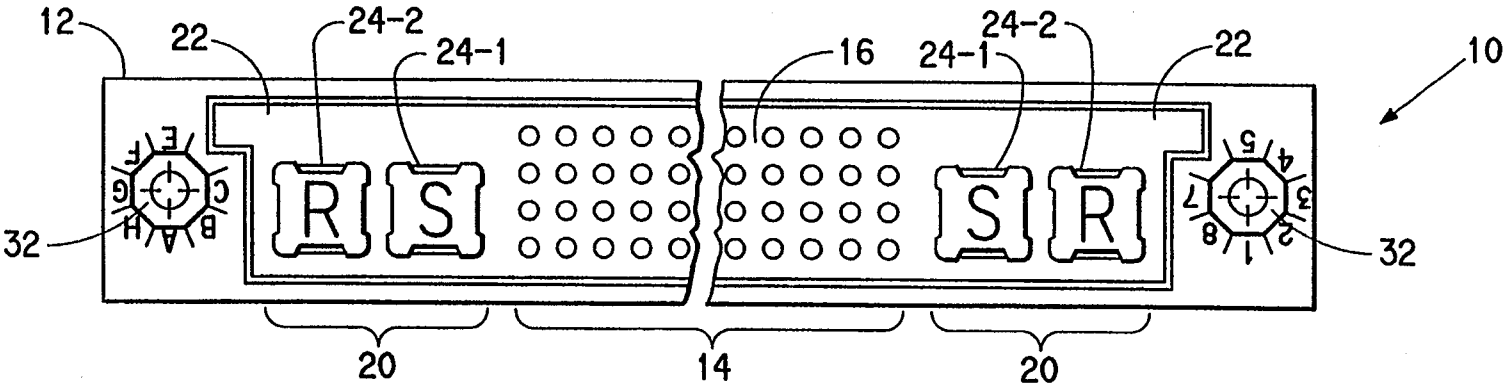
FIG. 1B (PRIOR ART)
Figure 1C:
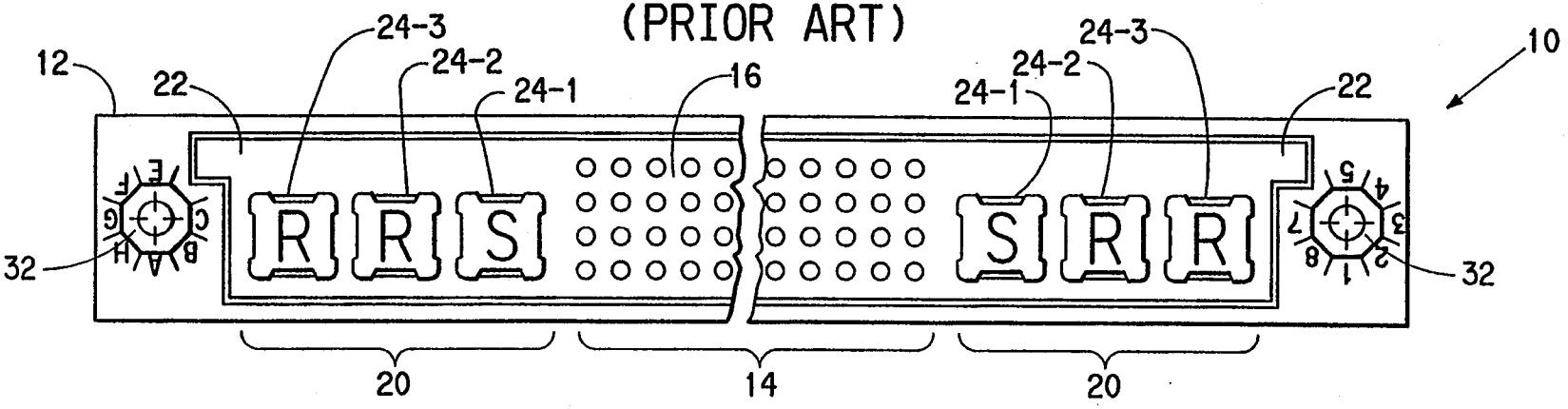
FIG. 1C (PRIOR ART)
Figure 1D:
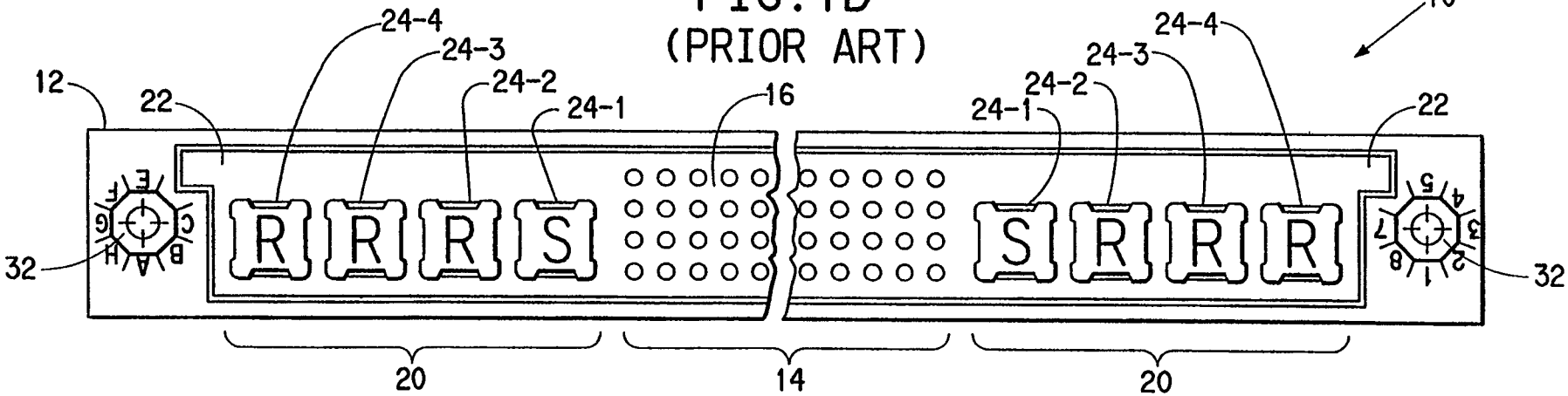
FIG. 1D (PRIOR ART)
Figure 2:
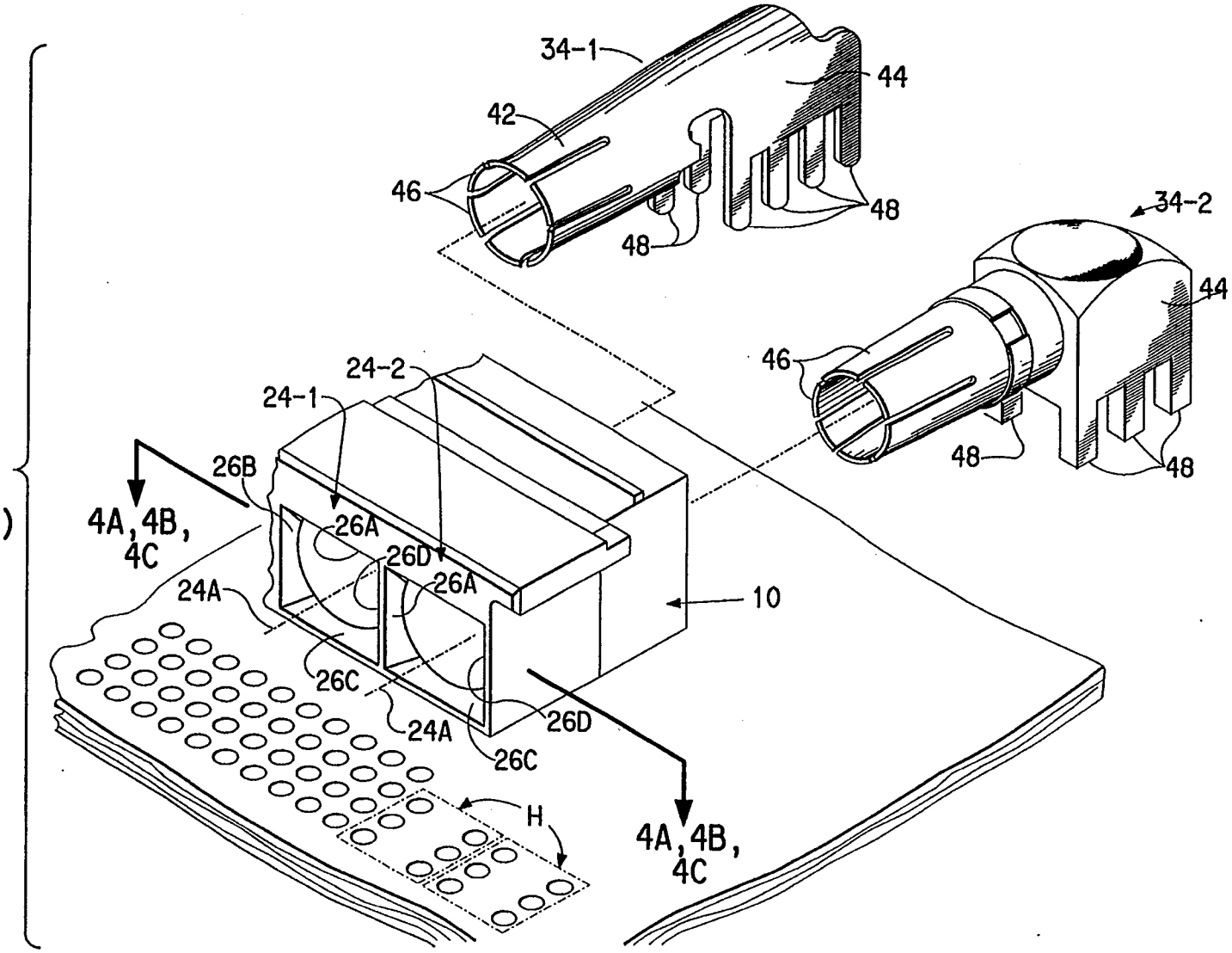
FIG. 2 (PRIOR ART)
FIG. 2 is a perspective view of a portion of a prior art header as shown in FIG. 1B having a power field with two power ports therein and illustrating two typical power receptacles receivable thereby.
Figure 3:
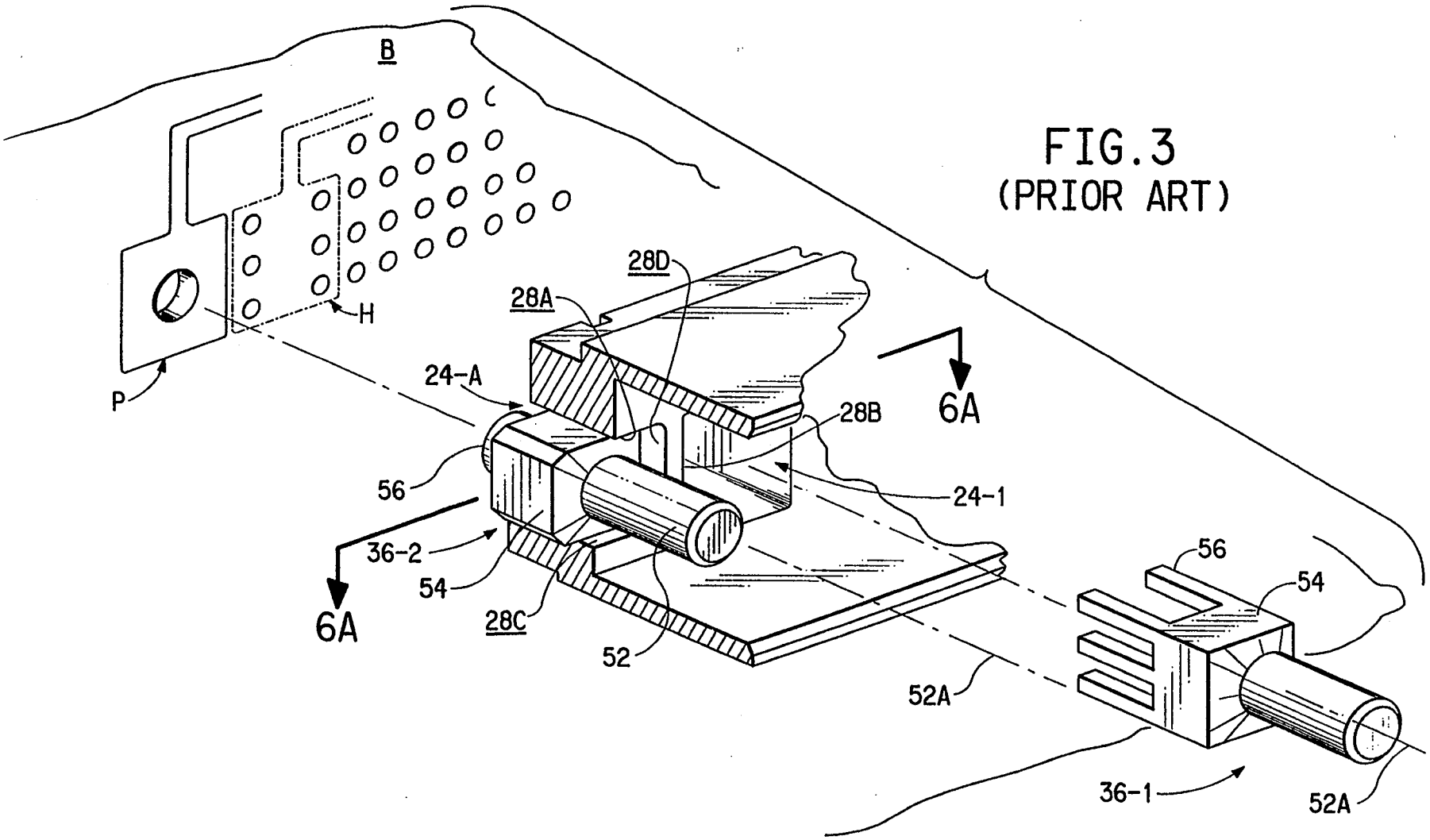
FIG. 3 (PRIOR ART)
FIG. 3 is a perspective view of a portion of a prior art header as shown in FIG. 1B having a power field with two power ports therein and illustrating two typical power pins receivable thereby.

One or both of the lateral regions 20 of the header 10 is provided with a power field 22. Each power field 22 may contain one or more power port(s) 24. Each port 24 may accommodate either a male power pin contact or a female power receptacle contact. In FIG. 1A only a single power port 24-1 is disposed at each lateral region 20. FIG. 1B illustrates the case in which each power field 22 contains a pair of power ports 24-1, 24-2. FIG. 1C shows each power field 22 with three power ports 24-1 through 24-3, while FIG. 1D illustrates the case of each power field 22 having four power ports 24-1 through 24-4. The extension to power fields having greater numbers of power ports is readily apparent. As is best seen in FIGS. 2 through 4 each power port 24 has an axis 24A that extends therethrough.

It is the practice in the industry that the power port 24-1 that is located next-adjacent to the signal field 16 has a generally square configuration, as indicated by the character "S" in the Figures. Any additional power port(s) in the power field have generally rectangular configuration(s), as indicated by the character "R". These conventions apply regardless of the number of power ports 24 that populate a power field. The relative location of the ports 24 with respect to the top and bottom edges of the header housing 10 depends upon the number of horizontal rows of signal contacts used in the header.

Keying receptacles 32 are disposed at the extreme lateral ends of the header 10.

As noted, depending upon the application a power port 24 may receive either a power receptacle 34 or a power pin 36. FIG. 2 is a perspective view of a header 10 with a power field 22 as in FIG. 1B, i.e., a field 22 containing a pair of power ports 24-1, 24-2. Each power port 24-1, 24-2 is adapted to receive a respective power receptacle 34-1, 34-2 therein. The signal contacts 16 in the signal field 14 are of the form of receptacles. To facilitate the entry of a power pin 36 into a corresponding power receptacle 34 each power port 24-1, 24-2 has four lead-in surfaces 26A through 26D provided therearound.

Each power receptacle, whatever its form, includes a barrel portion 42 and a mounting base portion 44. The barrel portion 42 typically includes a generally circular array of resilient fingers 46 that cooperate to define a socket able to receive the elongated shaft 52 of a power pin 36. The barrel portion 42 has an axis 42A that extends therethrough. The mounting base 44 has depending legs 48 that enable each power receptacle 34-1, 34-2 to be secured within an array of through-holes H provided in a substrate B. Suitable for use as the power receptacle 34-1 is a device sold by Electronics Department of E. I. du Pont de Nemours and Company. The power receptacle 34-2 may be .implemented using the stamped part disclosed and claimed in copending application Ser. No. 07/843,261 (EL-4338) assigned to the assignee of the present invention. Of course, any other suitable form of power receptacle may be used.

FIG. 3 is a perspective view of another header 10 with a power field 22 also containing a pair of power ports 24-1, 24-2 (FIG. 1B). However, in this instance each power port 24-1, 24-2 is adapted to receive a respective power pin 36 therein. To this end each power port 24-1, 24-2 is defined by at least four generally planar surfaces 28A through 28D. The signal contacts 16 in the signal field 14 are also in the form of pins.

Each power pin 36-1, 36-2 includes an elongated shaft portion 52 projecting from a mounting base portion 54. The shaft portion 52 has an axis 52A that extends therethrough. The mounting base portion 54 is provided with a suitable retention arrangement 56 whereby each power pin 36-1, 36-2 may be secured to a pad P or to an array of holes H disposed on or through a substrate B. Suitable for use as the power pins are the devices sold by Electronics Department of E. I. du Pont de Nemours and Company or as disclosed and claimed in copending application Ser. No. 07/847,666, filed Mar. 4, 1992 (EL-4351) and assigned to the assignee of the present invention.

-o-0-o-

In practice a header 10 having one or more power receptacles 34 (FIG. 2) is transported from a manufacturer to a customer with the receptacles 34 self-retained within the header 10. Due to the relatively large clearances, however, the receptacles are rather loosely received within their corresponding ports 24.

Figure 4A:
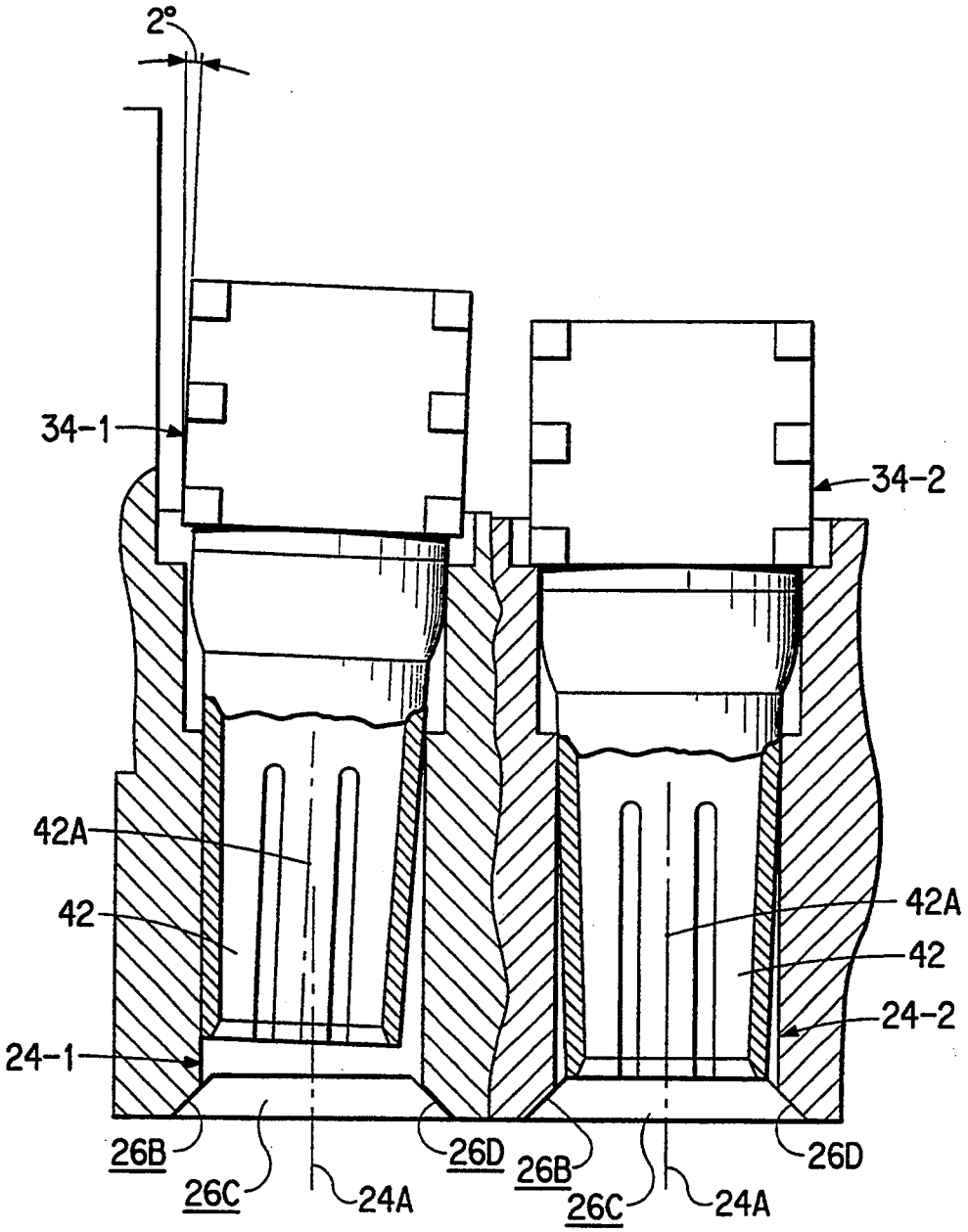
FIGS. 4A through 4C are horizontal sectional views taken along section lines 4—4 in FIG. 2, with FIG. 4A illustrating the misalignment of the axes of the barrels of power receptacles with respect to the power ports in which they are disposed and/or with respect to each other prior to the insertion of the locating tool in accordance with the present invention, while FIGS. 4B and 4C respectively illustrate the reaction of the barrels of the power receptacles to the progressive introduction of the locating tool thereinto.
Figure 4B:
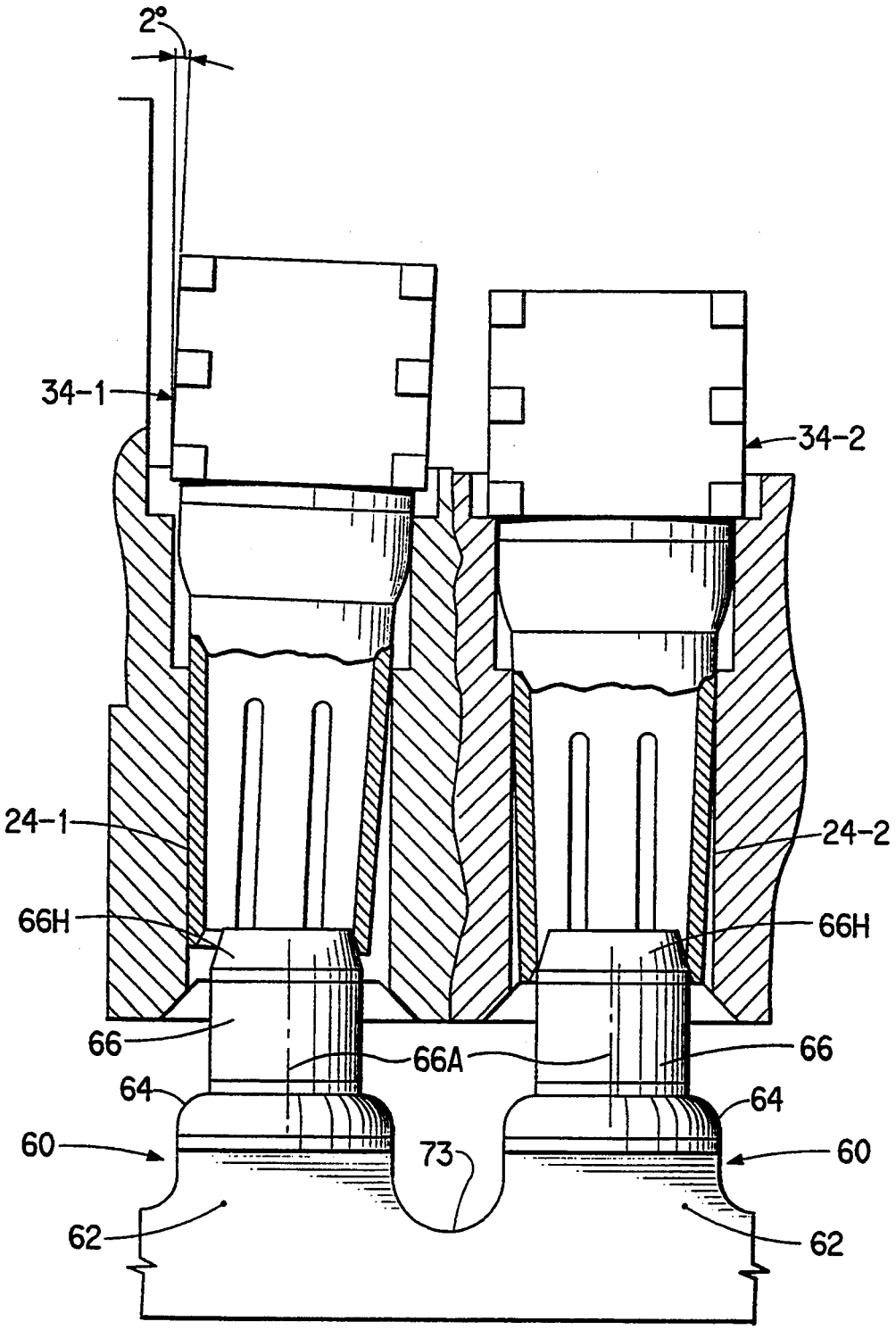
Figure 4C:
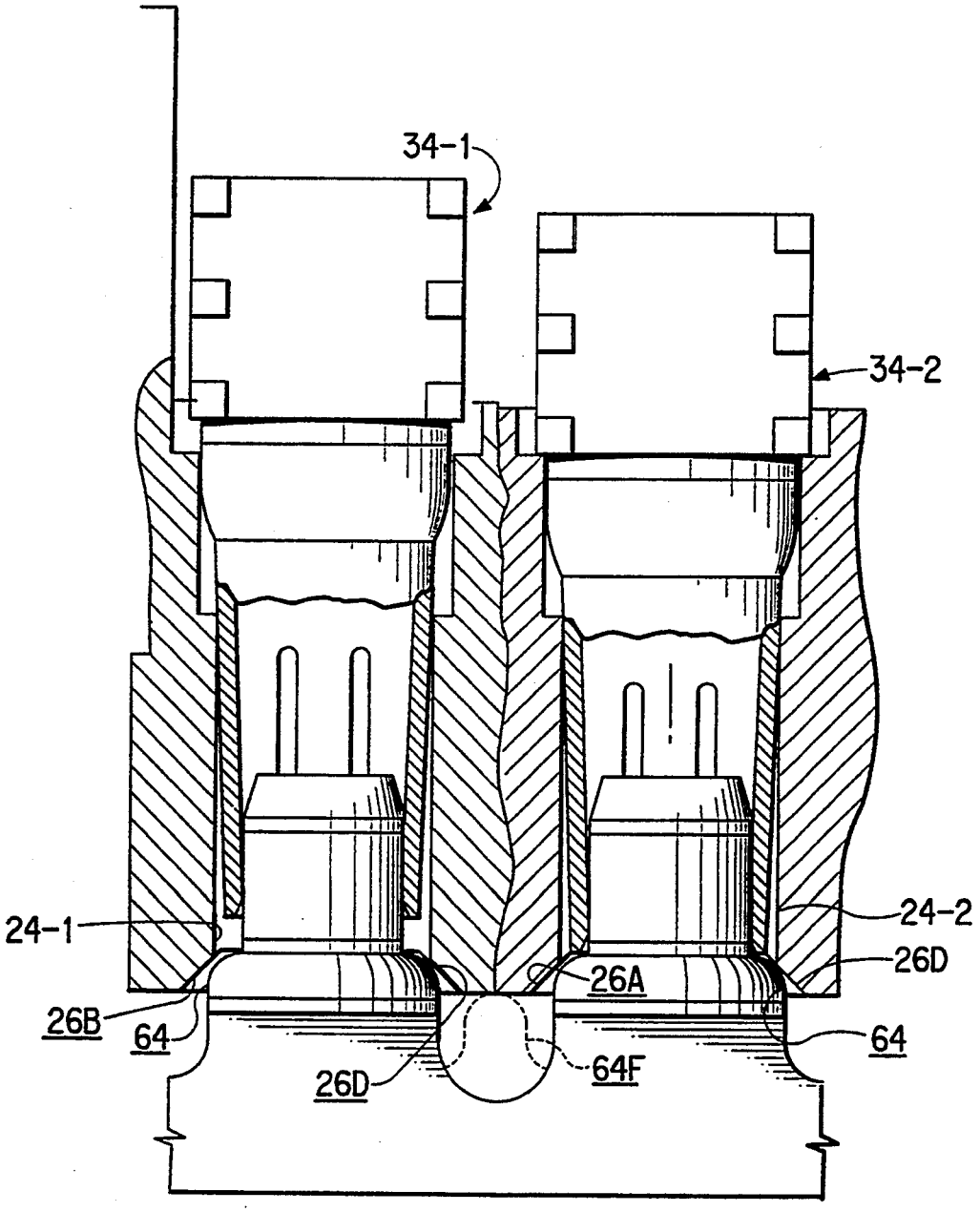
Figure 5A:
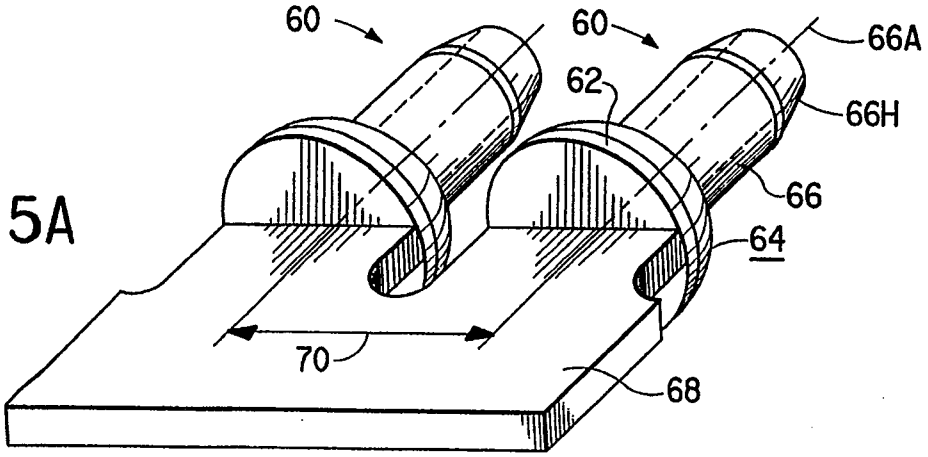
Figure 5B:
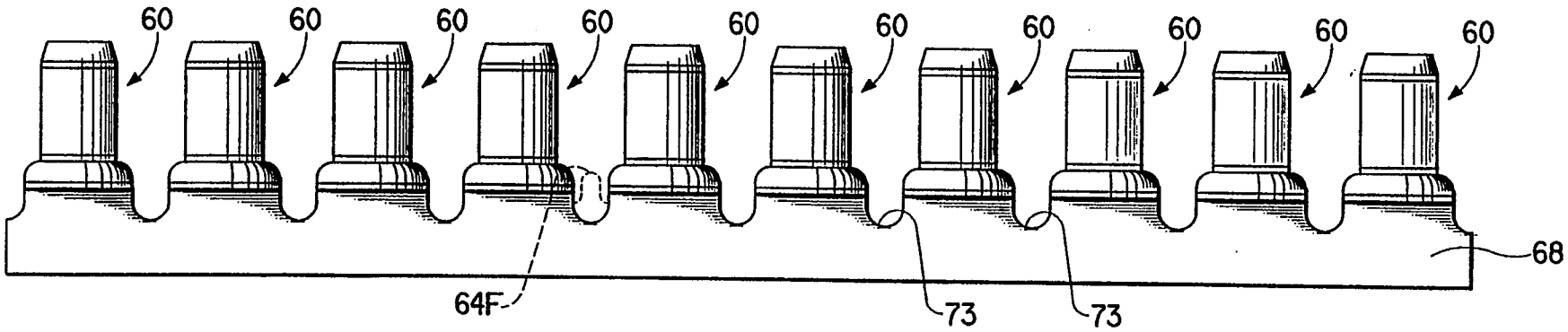
FIG. 5B is a elevational view of a plurality of tools connected on a web.

In such a state, in a header 10 having power receptacles 34 therein (FIG. 2) the axes 42A of the barrels 42 of adjacent power receptacles 42 may lie in misalignment with respect to the axis 24A of the port in which the barrel 42 is received. Moreover, if plural receptacles 42 are provided in a given header 10, the axes 42A of the barrels of adjacent receptacles 34 may lie in misalignment with respect to each other. This condition is illustrated in FIG. 4A. As a consequence the customer is left with the labor intensive task of properly locating the receptacles prior to their attachment to the openings on the substrate the header is to populate.

FIGS. 4A through 4C and FIG. 5 illustrate a disposable locating tool generally indicated by the reference character 60 for use with a header 10 having at least one power receptacle 34 therein which overcomes the disadvantages of misalignment between the axis 42A of the barrel 42 of a receptacle 34 and the axis 24A of its associated power port 24 and, in the event plural power receptacles are provided, the disadvantages of misalignment between or among the plural receptacles.

The locating tool 60 includes a base portion 62 having a positioning contour 64 thereon. A plug portion 66, having an axis 66A extending therethrough, extends from the base 62. Preferably, the plug portion 66 is hollow and has a tapered head 66H thereon. As may be appreciated from FIGS. 4B and 4C, the head 66H of the plug 66 is tapered to be easily insertable into the barrel of the receptacle, regardless of its likely orientation within the port. When the positioning contour 64 on the base 62 is engaged against against a portion of the header housing, preferably at least two opposed lead-in surfaces 26A, 26C, or 26B, 26D disposed about the first port 24-1 the plug 66 extends into the barrel 42 of the first receptacle 34A. This has the effect of bringing the axis 42A of the barrel 42 into alignment with the axis 24A of the first power port 24. Since the aligning action of the locating tool 60 is brought about by engagement between the contour 64 and an opposed pair of lead-in surfaces, the aligning action is effective whether the configuration of the power port 24-1 into which the tool is inserted is square (the conventional case) or whether is exhibits a rectangular or other configuration (e.g., ports 24-2 through 24-4). When the port has a square configuration the contour 64 engages against all four of the lead-in surfaces.

In the more usual case in which there are plural power receptacles 34A and 34B, a second locating tool 60, identical in all respects to the tool previously described, is provided. In the preferred implementation the locating tools 60 are carried on a web 68. The axes 66A of the plugs 66 of the adjacent tools 60 are precisely spaced a distance 70 from each other. As a consequence, when the positioning contour 64 on the second base 62 engages against a portion of the header housing, preferably at least two opposed lead-in surfaces 26A, 26C, or 26B, 26D disposed about the second port 24-2 the second plug 66 extends into the barrel 42 of the second receptacle 34B. This has the effect of not only bringing the axis 42A of the second barrel 42 into alignment with the axis 24A of the second power port 24-2, but also locating the axes 42A of the barrels of the receptacles precisely in parallel relationship. Thus, after the receptacles 34 are affixed to the substrate B and the tools 60 then removed, the adjacent receptacles are arrangement to expeditiously receive the power pins in a mating header. The scallops 73 formed on the web 68 provide a convenient location at which a removal tool may be inserted to remove the web 68 from the header.

It is noted that the positioning contour may be engaged against portions of the header housing other than the lead-in surfaces and still remain within the contemplation of the present invention. Preferably, the portion of the housing against which the positioning contour acts lies in the vicinity of the ports 24 in which the receptacle is received. For example, the positioning contour 64 may be modified to include a suitable feature 64F (indicated in dot-dash lines in FIGS. 4C, 5B, 5C) that engages the solely or additionally against the portion of the header housing on the frontal surface thereof between adjacent ports 24 in order to locate the barrel(s) of the receptacles in the manner described above.

In the preferred case the tools 60 are fabricated from any suitable temperature-stable material, such as polyphenylenesulfide plastic. The tools 60 are preferably integrally molded on the web 68.

-o-0-o-

In the instance where the header 10 is provided with one or more power pins (FIG. 3), the power pins are not self-retained but are rather loosely received within the corresponding ports 24 formed in the header 10. As before, when in such a state the axis 56A of the shaft 56 each power pin 52 may be misaligned with respect to the axis 24A of the power port in which the pin 52 is received, or, if plural pins 52 are provided, the axes 56A of the shafts 56 of adjacent pins 36 may be misaligned with respect to each other. Again, as a consequence the customer is left with the labor intensive task of properly locating the pins prior to their attachment to the openings on the substrate the header is to populate.

FIGS. 6A, 6B and 7A through 7C illustrate a disposable locating tool generally indicated by the reference character 74 for use with a header 10 having at least one power pin 36 therein which overcomes the disadvantages of misalignment between the axis 52A of the shaft 52 and the axis 24A of its associated power port 24 and which overcomes the disadvantages of misalignment between or among the plural pins in the event plural power pins are provided.

The locating tool 74 includes a sleeve 76 having a central bore 78 extending therethrough and an outer positioning surface 80 thereon. The shaft 52 of the power pin 36 is receivable in and retainable by the sleeve 76. The sleeve 76 is sized such that when the positioning surface thereon engages against at least two opposed surfaces 28A, 28C or 28B, 28D of the port the axis 52A of the shaft 52 of the pin 36 is brought into alignment in a predetermined relationship with the housing. Since the aligning action of the locating tool 74 is brought about by engagement between positioning surface 80 and an opposed pair of surfaces 28 defining the port 24, the aligning action is effective whether the configuration of the power port 24-1 into which it is inserted is square (the conventional case) or whether is exhibits a rectangular or other configuration. When the port 24-1 has a square configuration the positioning surface 78 engages against all four of the surfaces 28 defining the port.

In the more usual ease in which there are plural power pins 36A and 36B, a second, identical, locating tool 74 is provided. Again, in the preferred case the locating tools 74 are carried on a web 82. The axes 76A of the sleeves 76 of the adjacent tools 74 are precisely spaced a distance 84 from each other. As a consequence when the positioning surface 80 on the second sleeve 76 engages against at least two opposed surfaces 28A, 28C, or 28B, 28D disposed about the second port 24-2 the aligning action of the sleeve 76 serves to bring the axes 52A of the shafts 52 of the pins 36 into parallel relationship with each other and with the axes of the ports in which they are disposed. Thus, after the pins 36 are affixed to the substrate B and the tools 74 removed the adjacent pins 36 are properly arranged for expeditious insertion into a receptacle in a mating header. Scallops 87 (FIG. 6B) facilitate this removal.

Figure 6B:
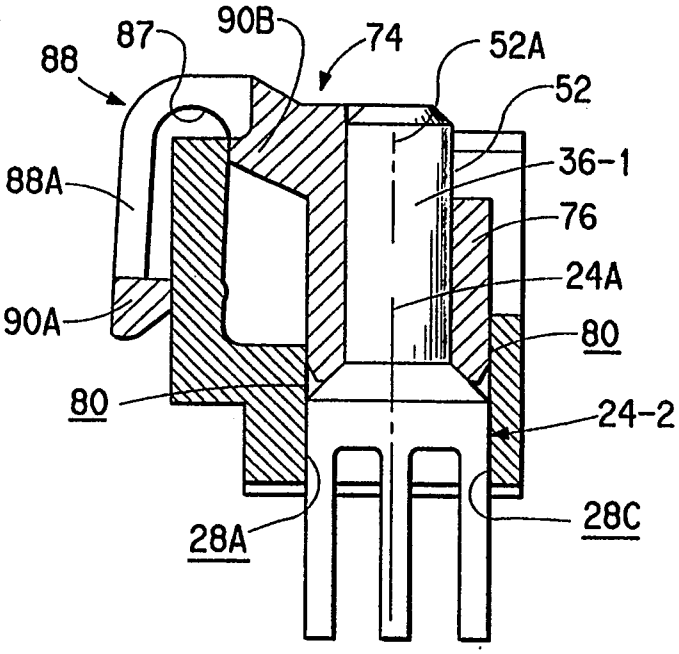
FIGS. 6A and 6B are, respectively, horizontal and elevational sectional views taken along section lines 6A—6A, 6B—6B in FIG. 2, illustrating a locating and retaining tool in accordance with the present invention.
Figure 6A:
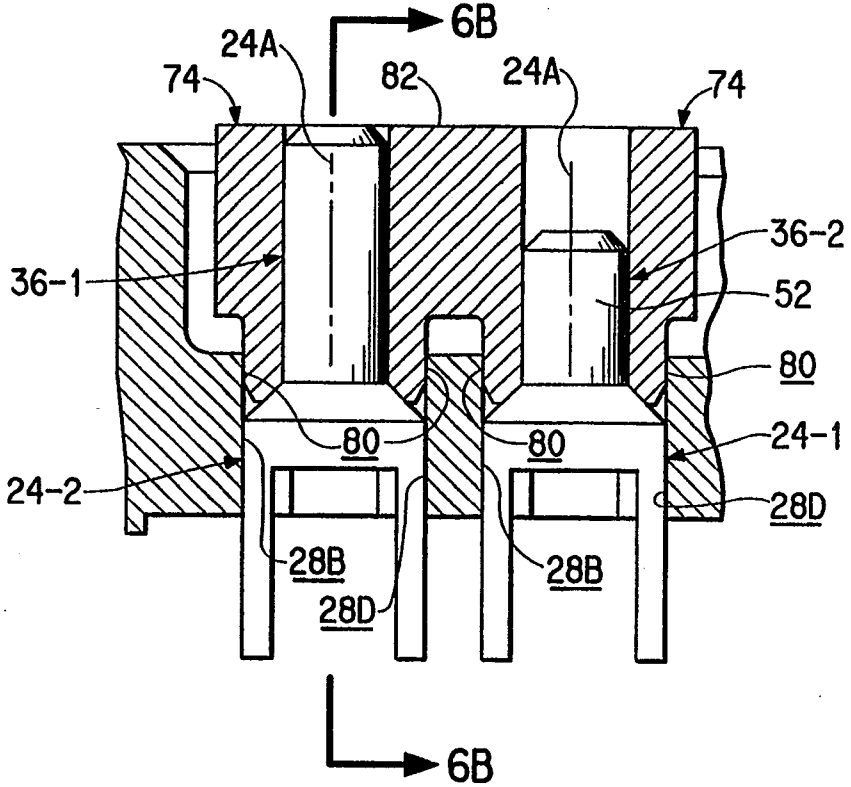
Figure 7B:
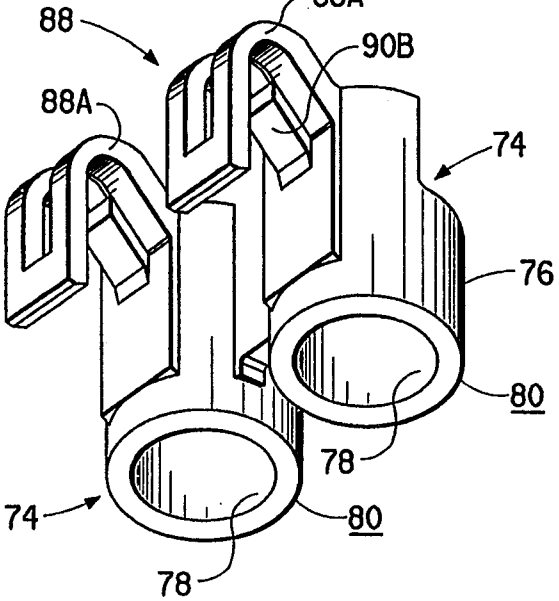
Figure 7A:
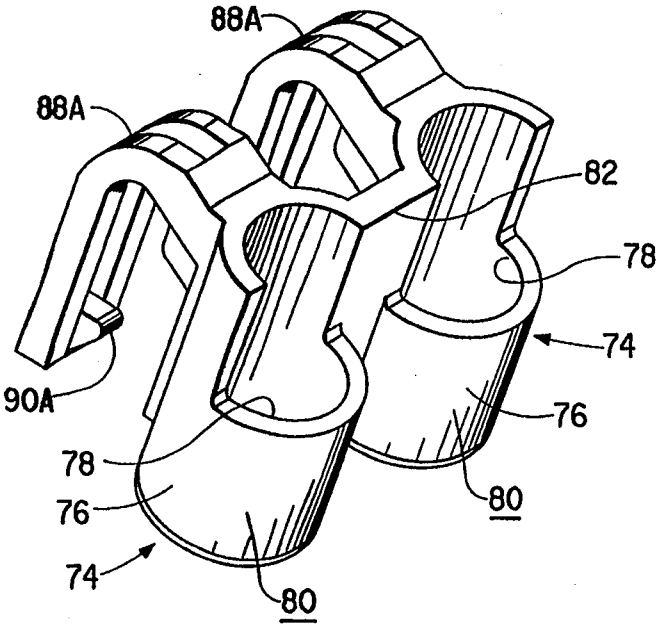
Figure 7C:
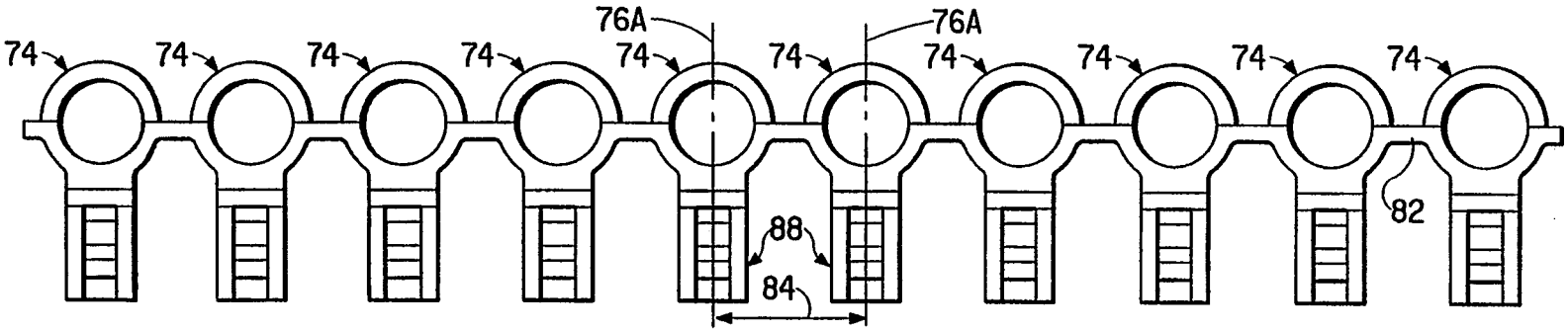
FIG. 7C is an elevational view of an array of tools connected on a web.

As is believed best seen in FIG. 6B a clip 88, including a clip arm 88A and a pair of clip abutment 90A and 90B, may be formed with at least one sleeve 76. Preferably the clip 88 is integrally formed with sleeve 76. The clip 88 is attachable to the header 10 thereby to hold the sleeve 76 within the port. If plural tools 74 are provided on a web 82, two or more clips 88 may be appropriately located either on the web 82 or on selected sleeves 76. The clips 88 may be formed in any alternate manner.

In the preferred case the tools 74 are fabricated from any suitable temperature-stable material, such as polyphenylenesulfide plastic. The tools are integrally molded on the web 82.

-o-0-o-

Those skilled in the art, having the benefit of the teachings of the present invention as hereinabove set forth may effect numerous modifications thereto. Such modifications as are discussed herein and which appear to those skilled in the art are to be construed as lying within the scope of the present invention, as defined by the appended claims.

What is claimed is:

1. A disposable pin locating tool for use with a pin header housing, the housing having adjacent first and second power pin-receiving ports defined by at least four surfaces and having an axis therethrough, each power pin-receiving port having a power pin disposed therein, each power pin having an axis, the axis of each power pin being able to lie in misalignment with respect to the axis of the port in which it is disposed and with respect to the axis of the adjacent power pin, the disposable pin locating tool comprising:

a web;

first and second adjacent sleeves connected to the web, each sleeve comprising a non-conducting material and having a central bore extending therethrough and an outer positioning surface thereon, each sleeve having an axis therethrough, the axis of the sleeves being spaced a predetermined distance apart, the power pin being receivable in and retainable by the sleeve, each sleeve being sized such that when the positioning surface thereon engages against at least two opposed surfaces of the port each pin extends into the bore of one of the sleeves to bring the axis of each pin into alignment with the axis of the port in which the pin is disposed and simultaneously to space the axis of the first pin the predetermined distance from the axis of the second pin.

2. The disposable pin locating tool of claim 1, wherein each port is square, and wherein the positioning surface of each sleeve engages against all four surfaces of the port.

3. The disposable pin locating tool of claim 1, wherein the first and second sleeves are integrally connected to the web.

4. The disposable locating tool of claim 1, further comprising a clip integrally formed with each of the sleeves, the clip being attachable to the housing thereby to hold the sleeve within the port.

* * * * *